United States Patent [19]

Zamboni

[11] Patent Number: 4,539,792

[45] Date of Patent: Sep. 10, 1985

[54] APPARATUS FOR SEQUENTIAL SUPPLY OF SWEETS OR LIKE ARTICLES TO CONTINUOUSLY MOVING PACKING APPARATUS OR MACHINES

[75] Inventor: Alderino Zamboni, Budrio, Italy

[73] Assignee: Risvin - Ricerche E Sviluppo Industriale S.r.l., Budrio, Italy

[21] Appl. No.: 522,184

[22] Filed: Aug. 10, 1983

[30] Foreign Application Priority Data

Aug. 18, 1982 [IT] Italy ..... 3512 A/82

[51] Int. Cl.[3] ..... B65B 77/34

[52] U.S. Cl. ..... 53/234; 53/227; 53/370; 198/478.1

[58] Field of Search ..... 53/225, 325, 227, 228, 53/234, 370; 198/377, 478, 443, 480

[56] References Cited

U.S. PATENT DOCUMENTS

| | | | |
|---|---|---|---|
| 2,987,861 | 6/1961 | Brook | 53/225 |
| 3,001,351 | 9/1961 | Brook et al. | 53/370 |
| 3,616,942 | 11/1971 | Gruber | 198/480 X |
| 3,987,605 | 10/1976 | Johnson | 53/234 |
| 4,245,733 | 1/1981 | Kubota et al. | 198/443 X |
| 4,370,925 | 2/1983 | Kazumi et al. | 198/480 X |

FOREIGN PATENT DOCUMENTS

| | | | |
|---|---|---|---|
| 1917175 | 10/1969 | Fed. Rep. of Germany | 198/443 |
| 57-27816 | 2/1982 | Japan | 198/443 |

*Primary Examiner*—Paul A. Bell

*Attorney, Agent, or Firm*—Karl F. Ross; Herbert Dubno

[57] ABSTRACT

An apparatus for the sequential supply of sweets or like articles to a continuously moving packing machine or apparatus of the type designed to convey the articles to be wrapped along a wrapping path or line having a mixed course comprising at least one horizontal rectilinear line. This supply apparatus is of the type having a construction with superimposed wheels which rotate coaxially with a continuous movement about a vertical axis, comprising a first upper plate wheel designed to receive the articles in bulk and to supply them in single file via a spiral duct to the periphery of a second lower disc wheel provided peripherally with a plurality of apertures which are equally spaced, below each of which are provided means having gripper members for the take up of the articles associated with a lower third wheel such that they are radially slidable and may be oriented about a respective vertical axis. In this way, the articles are spaced by the peripheral path below and along the straight horizontal path of the wrapping line of the wrapping machine and are constantly oriented with respect to this rectilinear horizontal line for their transfer to the wrapping machine.

6 Claims, 5 Drawing Figures

Figure 1:
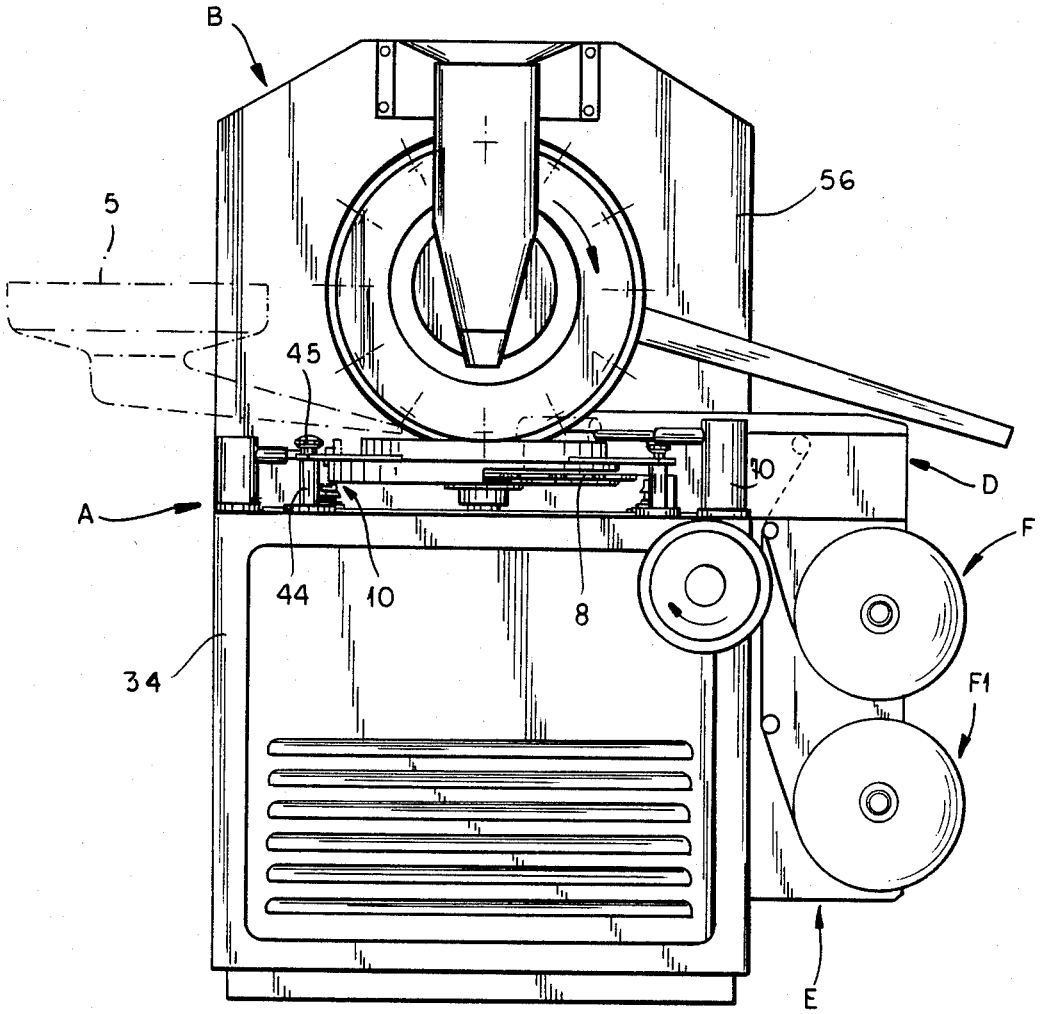

APPARATUS FOR SEQUENTIAL SUPPLY OF SWEETS OR LIKE ARTICLES TO CONTINUOUSLY MOVING PACKING APPARATUS OR MACHINES

The present invention relates to an apparatus for the sequential supply of sweets or like articles to continuously moving wrapping devices or apparatus.

The handling of products or articles such as sweets or the like and the processing of these for example by means of the formation of a wrapper on the products is normally carried out by conveying the products or articles by means of respective conveyor wheel elements provided with a discontinuous movement along a circular path for the sequential spacing and the formation of the wrapper by means of folding elements supported completely or in part by the respective conveyor element, i.e. with a movement comprising alternating forward feed and rest periods, during which latter periods the products fall into equally spaced cells with which the corresponding conveyor wheel element is provided for their sequential spacing, and almost all the operations for folding and/or passage or transfer of the products or articles from one conveyor element to the next.

In the case of handling devices designed in this way, i.e. having discontinuously moving conveyor elements enabling the sequential spacing of the products and the majority of the folding operations and/or their transfer from one conveyor element to the next during the rest periods of each alternation, the unit operating speed is necessarily somewhat limited and leads therefore to higher production costs.

In order to increase the unit operating speed of the handling devices in order obviously to decrease production costs for the corresponding articles or products which are obtained and/or processed, various types of device or apparatus have been proposed and are known commercially as continuously moving machines, although in practice these devices have proved to be nothing more than hybrids since, or at least during the stage of transfer of the product to be treated from the operating means of one conveyor member to subsequent means of a further conveyor member, the product is at rest as it is released from the operating means of the preceding conveyor member or brought to a standstill by stop means and thus contacted for checking or taking up by the operating means of the following conveyor member with possible damage to the product itself and, in any case, with drawbacks relating to uniformity in the subsequent conveyor stage (see German Patent Specification No. 2 416 656) or even because these operating means are disposed facing away from one another at a single tangential point at the time of take-up of the product for its passage from one conveyor element to the next (see U.S. Pat. No. 3,001,351), or because the operating means are provided with a constant, i.e. high, circular conveying speed even for the more delicate handling operations such as, for example, the transfer or passage itself of the product from one conveyor element to the next, or even the more delicate operation of checking or taking up of the product and the various elements, such as wrapping materials, which may be involved in the handling operation, in particular during the stage of supply to the operating means of the respective conveyor members.

The applicant's copending U.S. patent application Ser. No. 433,552, filed on Oct. 8, 1982 discloses a method and a device for the handling of products by means of operating means caused to move continuously along a path having a mixed course with sections which are rectilinear, spiral, circular and curved in any way and which follow one another, although in an intercalated manner and at different speeds in accordance with the type of operation to be carried out on the product.

In accordance with this method and device, the individual products or articles of a series of products or articles to be handled or treated are conveyed in the first place, for example, along a path section having a rectilinear course at a low speed in order to provide improved control during their supply stage to the operating means and thus, once under control by the said operating means, along a path having a curved course at a gradually increasing speed so as to space them and subject them to particular operations, and then along a rectilinear path at a different speed for a further operation, and so on in accordance with the number and type of operations to be carried out with respect to the type of product to be treated.

In this way it is obvious that there is a particular consequent possibility of carrying out operations for transfer or passage of products or articles to be treated from the operating means of a conveyor member to the operating means of a subsequent conveyor member, for example along one of the sections of the path having a rectilinear course, even at a slower speed, completely cancelling out any relative speed irrespective of the conveyor speed level.

In accordance with the applicant's above mentioned application Ser. No. 433,552 the said continuously moving conveyor members are preferably provided as wheels having radial support guides on which are slidably mounted the operating means having support constructions with which are associated means for their movement along the respective radial support guide in order to move them away from and/or towards the axis of rotation of the corresponding continuously moving conveyor member such that they are continuously displaced along the above-mentioned path having mixed sections and at different speeds. The operating means provided are of the type comprising heads with take up elements having a permanent magnet or suction effect, or are constituted by gripper take-up elements, whilst the means for displacing the said operating means along the respective radial support guide are, for example, of the type having a common actuation cam, or an individual actuation cam, for example using motors of the so-called step-by-step type or other like actuation means. In addition, during the stage for the transfer or passage of the product from the operating means of a conveyor wheel element to the operating means of a further conveyor wheel element operating along a rectilinear section the said operating means are orientated about respective axes parallel to the axes of the said respective conveyor wheel elements so as to maintain constant the orientation of the product along the entire rectilinear transfer section. Finally, the axes of the operating means parallel to the axes of the respective conveyor wheel elements may be provided, in terms of the combination with the said conveyor wheel elements, such that they are all parallel or, respectively perpendicular.

In accordance with the applicant's further copending U.S. patent application Ser. No. 522,185, filed on Aug.

10, 1983, there is provided an apparatus for the continuous wrapping of sweets or like articles or products, comprising a rotary wheel moving continuously about a horizontal axis which is associated in a radially slidable manner in an equally spaced arrangement with a plurality of handling devices having heads oscillating about an axis parallel to the axis of rotation of the said rotary wheel in accordance with a further copending U.S. patent application 522,183, filed Aug. 10, 1983, in the applicant's name, which causes the operating elements of these oscillating heads to act in a continuous sequence above and along a rectilinear, horizontal supply section for the sweets to be wrapped, thereby cancelling out any relative speed between the sweets and associated wrapping materials and the said operating elements.

The present invention relates to an apparatus for supplying sweets or like articles to continuously moving wrapping devices or apparatus of the type set out in the above-mentioned patent application Ser. No. 522,185 which is designed to space the sweets or like articles or products and to supply them to these continuously moving machines or apparatus along a rectilinear horizontal section. More particularly, this supply apparatus is of the type having superimposed wheels which rotate coaxially with a continuous movement about a vertical axis, of which the upper wheel is designed to receive sweets in bulk and to supply them in single file via a duct having a spiral course to the periphery of a second lower wheel provided peripherally with equally spaced apertures at the level of and below which are provided take-up elements for the individual sweets associated with a third lower wheel in a radially slidable manner such that they may be orientated about a respective vertical axis so as to convey these sweets along the rectilinear horizontal section with a constant orientation with respect to the horizontal rectilinear section.

The object of the present invention is therefore an apparatus for the sequential supply of sweets or like articles to a continuously moving wrapping apparatus of the type designed to convey the sweets to be wrapped along a wrapping path or line having a mixed course comprising at least one rectilinear horizontal section, the said apparatus being of the type having a superimposed wheel construction, which wheels rotate coaxially with a continuous movement about a vertical axis, and in which a first upper wheel is designed to received products in bulk and to supply them in single file via a duct having a spiral course to the periphery of a second lower wheel, which apparatus is characterised in that the said second wheel is provided peripherally with a plurality of equally spaced apertures which are open peripherally and in that below each of these apertures there are provided gripper take-up elements associated with a third, lower, wheel in a radially slidable manner such that they may be orientated about a respective vertical axis in order to receive individual products and supply them from the peripheral path of the said second and third wheels along a rectilinear horizontal path section parallel to and below the rectilinear horizontal section of the wrapping line of the wrapping machine with a constant orientation with respect to these rectilinear horizontal path sections in order to supply them to this continuously moving wrapping machine or apparatus.

Figure 2:
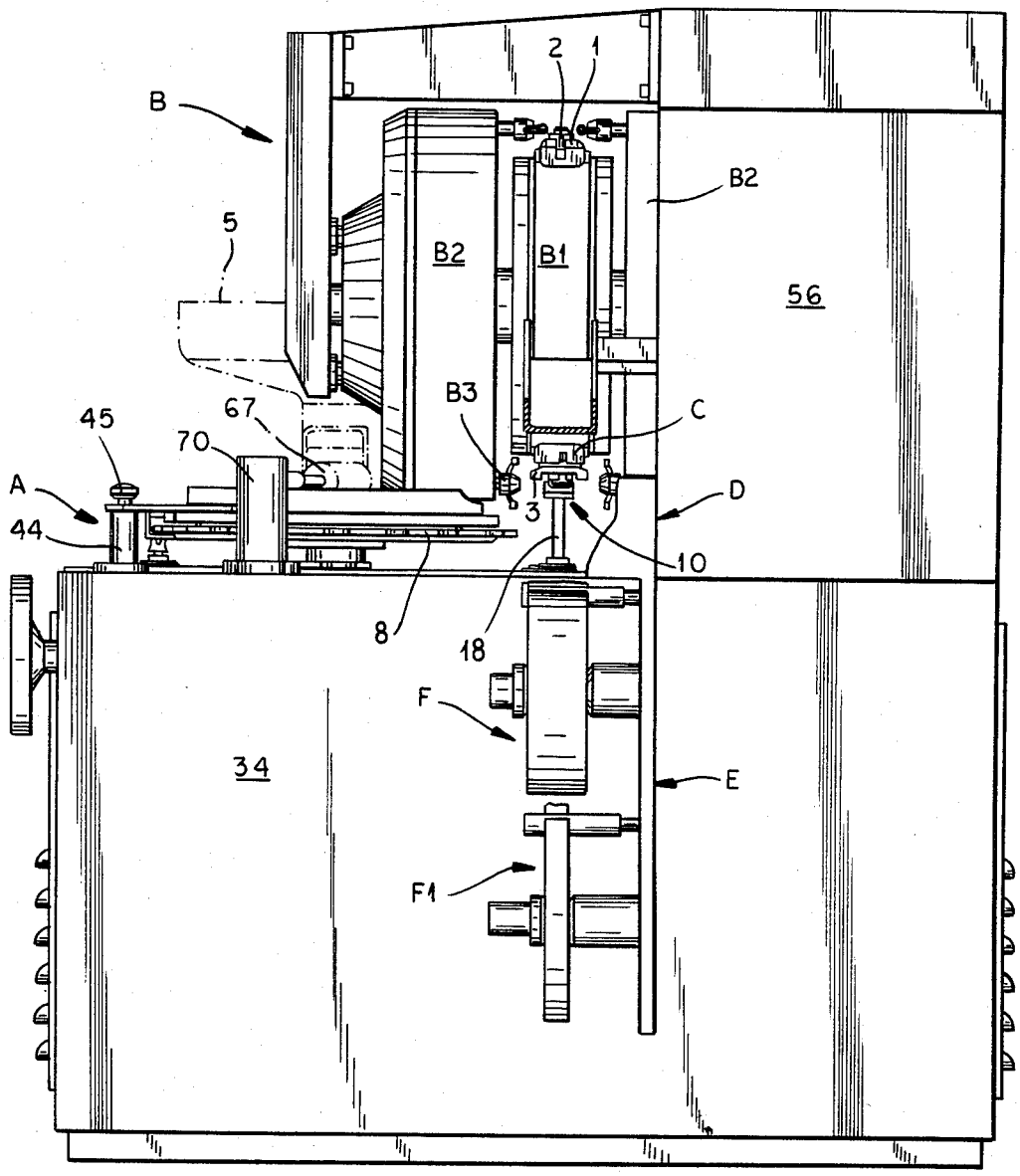
Figure 3:
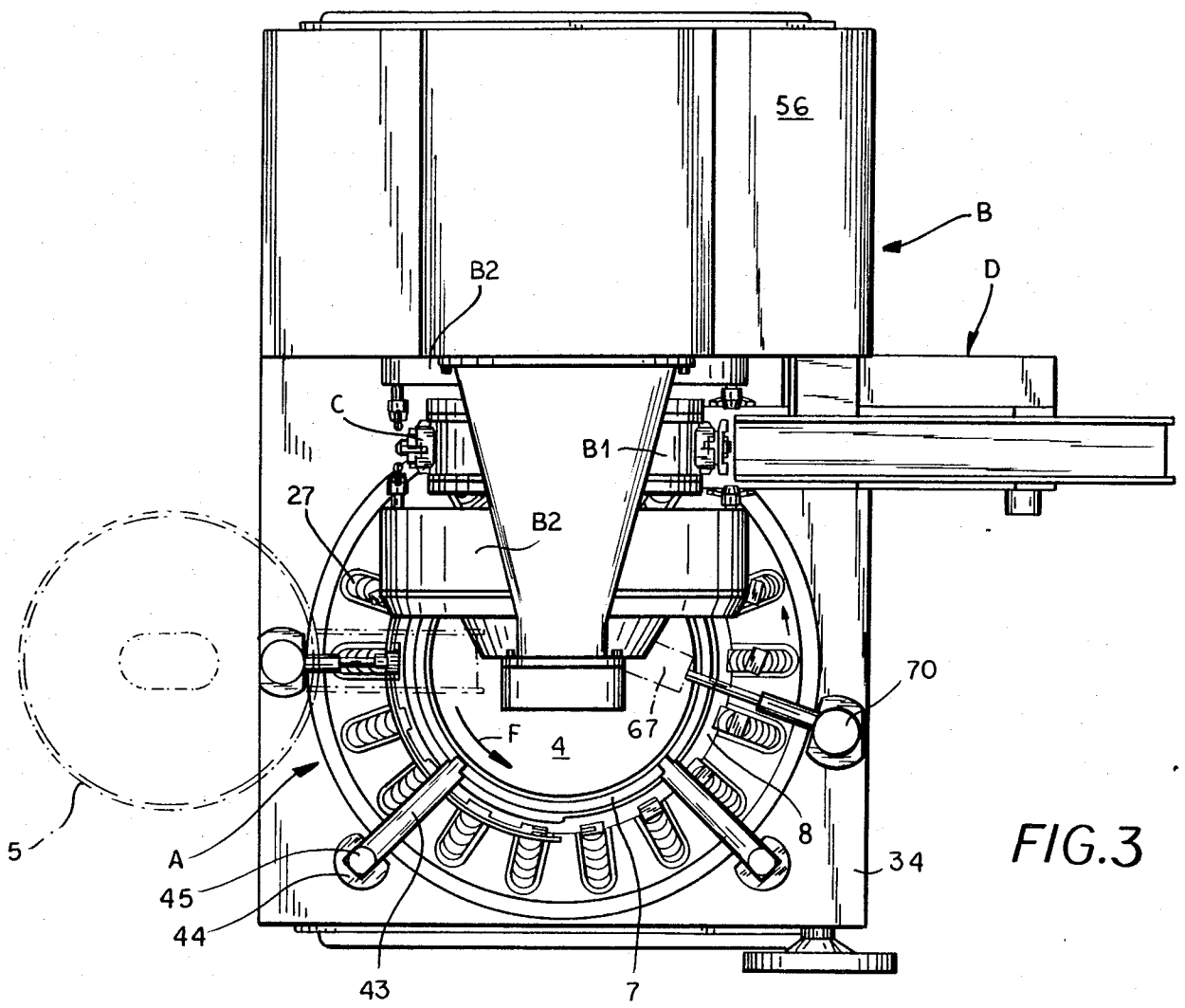
Figure 4:
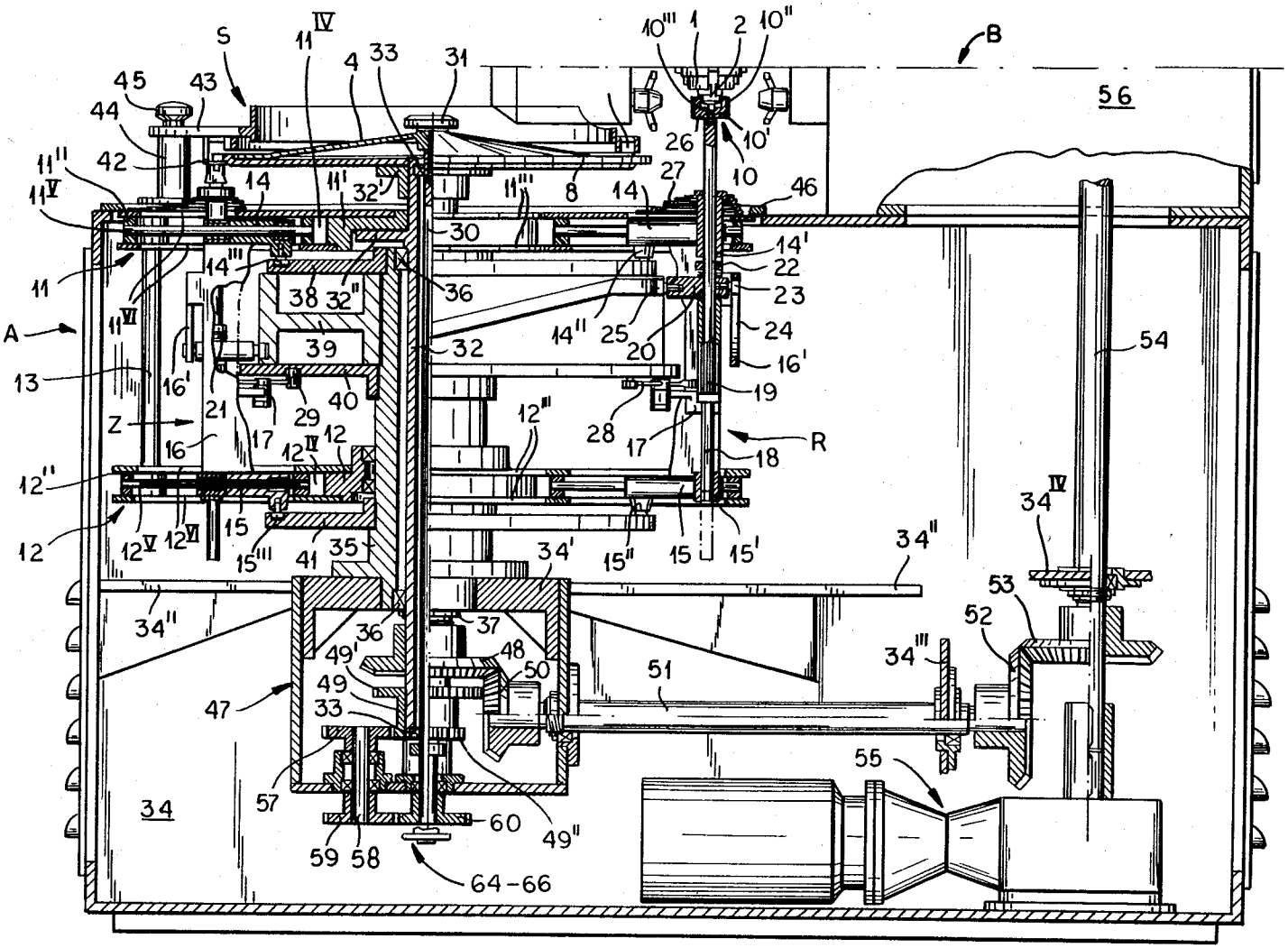
Figure 5:
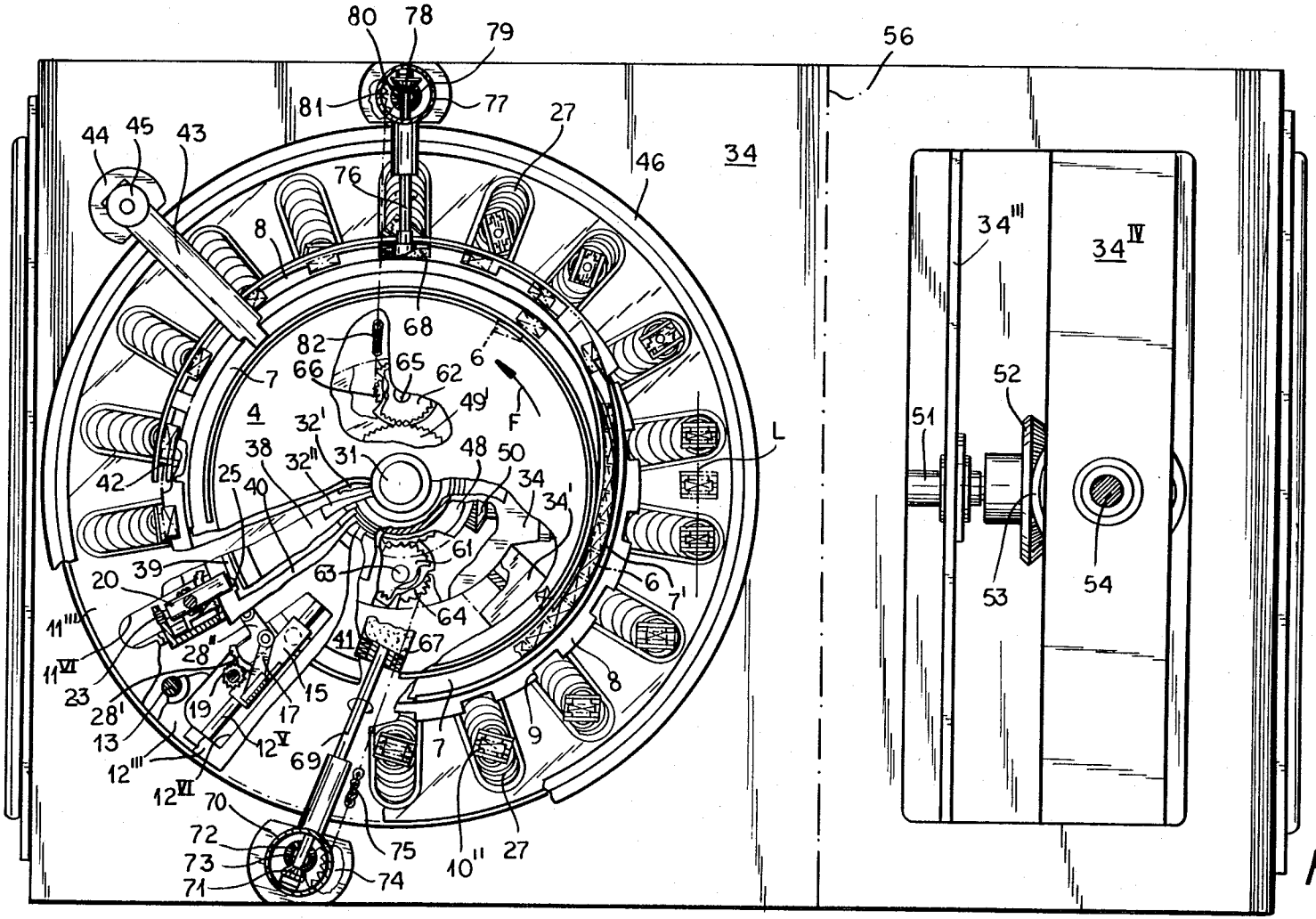

The attached drawings show, by way of non-limiting example, a preferred practical embodiment of this continuously moving supply apparatus in accordance with the invention. In these drawings:

FIGS. 1, 2 and 3 show the invention in combination with a wrapping apparatus for products having a continuous movement designed to convey these products along at least one horizontal rectilinear path section so as to form with this letter apparatus a high speed continuous wrapping machine, FIG. 1 showing a front external elevation, FIG. 2 showing a lateral external elevation and FIG. 3 showing a top view., FIG. 4 is a vertical axial section on an enlarged scale and FIG. 5 is a top view with respect to FIG. 4.

The supply apparatus in question is described with respect to a construction of a continuously moving wrapping machine designed to supply in sequence sweets or like products at a high production speed, i.e. approximately 2000 (two thousand) sweets from the first minute, to the continuously moving wrapping apparatus according to the above mentioned U.S. application Ser. No. 522,185, using a plurality of handling devices in accordance with the above mentioned U.S. application Ser. No. 522,183.

FIGS. 1, 2 and 3 show at A the apparatus in question for the sequential supply of sweets constituting the lower portion of the wrapping machine and at B the wrapping machine according to the above-mentioned U.S. patent application Ser. No. 522,185 designed to wrap the said sweets in the so-called double twist wrapper shape and constituting the upper portion of the wrapping machine and at C the handling devices according to the above mentioned U.S. application Ser. No. 522,183 and associated in a uniformly spaced arrangement with the continuously moving wheel portion B1 of the wrapping apparatus B, and at D an apparatus of known type for cutting strips of wrapping material and supplying pieces of this material for wrapping the sweets, substantially disposed at the level of the horizontal plane of junction between the said lower apparatus A in question for supplying the sweets and the said upper apparatus B for wrapping the sweets, and at E a support construction designed to support spools of wrapping material in strip form F and F1, also of known type, disposed below the cutting and supply apparatus D for the pieces of wrapping material.

The apparatus B is designed to wrap sweets by conveying them with a continuous movement along a wrapping line or path having a mixed course comprising at least one rectilinear horizontal section. For further details of the operational structure of this wrapping apparatus B for the sweets reference should be made to the above mentioned U.S. patent application Ser. No. 522,185. This apparatus essentially comprises the wheel B1 rotating with a continuous movement about a horizontal axis, a plurality of handling devices C having oscillating heads 1 and mounted in a radially slidable manner with an equal spacing on the rotary wheel B1, with the axis of oscillation of the oscillating head 1 parallel to the axis of rotation of the rotary wheel B1, and gripper take-up member means 2 and hoe-shaped folding means 3 supported by the said oscillating heads 1 so as to oscillate about respective axes parallel to the axis of oscillation of the oscillating head 1 and the axis of rotation of the rotary wheel B1. Two wheels B2 supporting a respective corresponding plurality of twisting devices B3 in a miror symmetrical arrangement at the opposite sides of the above-mentioned gripper take-up member means 2 and the hoe-shpaed folding means 3 supported by the oscillating head 1 are provided coaxially rotatable with and on the opposite sides of the wheel B1 supporting the handling devices C having oscillating heads 1.

The supply apparatus A in question is of the type having a superimposed wheel construction, which wheels rotate coaxially with a continuous movement about a vertical axis, a first upper wheel 4 being designed to receive the articles or sweets 6 in bulk from a known supply-vibrator device 5 (see FIGS. 1, 2 and 3) and to supply them in single file (see in particular FIG. 5) via a spiral duct 7 to the periphery of a second lower disc wheel 8 provided peripherally with a plurality of peripherally open equally spaced apertures 9. The wheel 4 is of the type having its central zone extending conically upwards so as to define a plane peripheral zone coplanar with the peripheral zone of the lower disc wheel 8 along which the above-mentioned peripherally open apertures 9 are provided. The internal wall which defines this duct 7 is spaced from the plane peripheral zone of the wheel 4 by a distance which is slightly greater than the thickness of the sweets 6 such that the latter are arranged longitudinally and in single file within and along this duct 7 under the action of the centrifugal force resulting from the rotation of the wheel 4. The duct 7 is provided with a spiral course 7' at a certain point, see the right-hand side of FIG. 5, such that the sweets 6 aligned in single file on the plane peripheral portion of the wheel 4 are transferred to the peripheral portion coplanar with the wheel 4 of the disc wheel 8 along which the apertures 9 are provided.

In accordance with the present invention, below the two coaxially superimposed wheels 4 and 8, see in particular FIGS. 4 and 5, there is provided a third rotating wheel, indicated overall by R, with which there is associated, in the manner described in more detail below, a plurality of take-up member means 10 designed to sequentially space the sweets 6 from the zone having a peripheral circular path of the wheel 8 along a rectilinear horizontal path L spaced from the external edge of this wheel 8 with a constant orientation (see FIG. 5).

The rotating wheel R is substantailly constituted, as shown in FIG. 4, by two superimposed wheels 11 and 12, each of which is formed by a central hub 11' and 12' and by a peripheral portion 11'' and 12'' which are respectively coplanar and held together by two respective opposite discs 11''' and 12''' by means of fixing element means $\mathbf{11}^{IV}$ and $\mathbf{12}^{IV}$ such as spacers and/or screws and the like. The hub 11' and 12' and the peripheral portion 11'' and 12'' are resectively connected by means of a plurality of guide and sliding rods $\mathbf{11}^{V}$and $\mathbf{12}^{V}$ in a spaced peripheral arrangement between the respecive opposite discs 11''' and 12''', whilst the two superimposed wheel 11 and 12 constituted in this way are connected together peripherally by a plurality of small columns 13 thereby producing the rotating wheel R.

The above-mentioned opposite discs 11''' and 12''' have, at the level of the said guide and sliding rods $\mathbf{11}^{V}$ and $\mathbf{12}^{V}$, a respective substantially radial aperture of eyelet $\mathbf{11}^{VI}$ and $\mathbf{12}^{VI}$ in order to enable the sliding of a respective carriage device mounted slidably in the manner described in detail below on the said guide and sliding rods $\mathbf{11}^{V}$ and $\mathbf{12}^{V}$ and indicated overall by Z. Each of the said carriage device Z is substantially constituted by two axially hollow horizontal bushing portions 14 and 15 both mounted slidably on the guide and sliding rods of each pair $\mathbf{11}^{V}$ and $\mathbf{12}^{V}$ and connected vertically by a respective vertical rib 16. The horizontal bushing portions 14 and 15 have a respective vertical bushing portion 14' and 15' which is also axially hollow and vertically aligned, whilst a support arm element 17 is fixed to the vertical rib 16.

In the vertically aligned axial bore of the vertical bushing portions 14' and 15' there is slidably and rotatably engaged a rod 18 which has an externally gear toothed cylindrical portion 19 fixed to its substantially intermediate portion. Above this geared portion 19, the rod 18 is inserted in a freely rotatable manner in a component 20 maintained in the axial direction on the rod between the component 20 and a series of disc springs 21 upwardly opposed by a retaining ring 22 which is rotationally rigid with the rod itself but slidable with respect to the rod by means of elements for mutual torsional engagement with an upward end of stroke which are not shown in the drawings. The component 20 is provided with an idler 23 which is slidably engaged in a vertical guide slot 24 provided in a portion 16' of the rib 16 of the carriage device Z and in the portion opposite to this idler 23 of a second cam follower idler 25 designed to cause the alternating axial displacement of the rod 18 as will be described below.

One of the above-mentioned take-up member means 10 is fixed in an interchangeable manner to the upper end of this vertical rod 18. Each of these take-up member means 10 is constituted by a cup 10' having a rectangular shape whose lateral walls for containing the sweets to be sequentially supplied in the manner described below are defined by four angle elements 10'' disposed at the four corners of its rectangular periphery (see FIG. 5). The base of the cup 10' is provided with a layer of resilient material or buffer 10''', for example of hard rubber, which may be fixed, together with the said cup 10'—10'', in an interchangeable manner, to the above-mentioned rod by a single screw 26. The cup 10'–10'' and the buffer 10''', contituting the said take-up member means 10, are the only so-called format components which may be interchanged as a function of the dimensions of the product to be handled.

At the upper end of the vertical bushing portion 14', forming part of the carriage devices Z, there is fixed in a known manner the central portion of a corresponding bellows element 27 whose peripheral portion is fixed, also in a known manner, to the external surface of the upper disc of the pair of opposite discs 11''' within the respective eyelet $\mathbf{11}^{VI}$. In this way the inner portion of the rotating wheel R is protected from possible sweet residues produced whilst they are being handled. The horizontal bushing portions, 14 and 15, also forming part of the carriage devices Z are, however, provided with a projection 14'' and 15'', facing downwardly, each of these projections being associated with a cam follower idler pin 14''' and 15'''. The arm support element 17, fixed to the rib 16 of the said carriage devices Z, supports a corresponding lever element 28 having two arms 28' and 28'' (see in particular FIG. 5) such that it may rotate about a vertical axis. The free end of the arm 28' of the lever 28 is shaped as a toothed sector in engagement with the toothing of the geared portion 19, whilst a cam follower idler 29 is provided at the free end of the arm 28''.

The upper conical plate wheel 4 is keyed on a vertical shaft 30 in a detachable manner by means of round-headed screw 31, whilst the lower disc wheels 8 with peripherally open apertures 9 and the rotating wheels R supporting the carriage devices Z are detachably mounted on a tubular shaft 32 by means of corresponding flanges 32' and 32'' and related locking screws (not shown). The shaft 30 supporting the upper conical plate wheel 4 is inserted coaxially in the tubular shaft 32 supporting the disc wheels 8 and rotating wheels R with the interposition of ball bearings 33.

An assembly of this type, constituted by the tubular shaft 32 with associated disc wheels 8 and rotating R and by the shaft 30 with the associated upper conical plate wheel 4 inserted in the shaft 32 is supported within the base 34 of the supply apparatus A of the present invention in the manner described below (see FIG. 4).

Within the base 34 there is provided a hub 34' supported by a plurality of radial ribs 34''. The shaft 34' has a central bore at the level of which there is fixed a tubular support column 35. The tubular shaft 32 of the assembly of three superimposed wheels 4, 8 and R is inserted in this tubular support column 35, and is supported with the interposition of radial thrust bearing tapered roller bearings 36 and is locked in the axial position by means of the ring nut 37. The external portion of this tubular support column 35 has fixed to it four bodies 38, 39, 40 and 41 each provided with a cam path in which the cam follower idlers 14''', 25, 29 and 15''' are respectively enagaged (see FIG. 4) for the operational synchronization movements for the supply apparatus in question as will be described below.

Furthermore, there is fixed above the two wheels 4 and 8, the system of walls or sides S which defines the duct having a spiral course 7–7' which also comprises a fillet 42 extending horizontally below the peripherally open apertures 9 of the disc wheel 8 through apparoximately 180° in the upper portion or zone as shown in FIG. 5. This fastening is carried out by means of a plurality of radial arms 43 (only one of which is shown in FIGS. 4 and 5) above the same number of columns 44 which are fixed to the upper horizontal wall of the base 34 by means of round-headed screws 45 such that the wall system S may also be readily removed. This upper horizontal wall of the base 34 also has fixed to it by means of known means, not shown, an annular seal 46 extending around and below the clearance between the annular edge of the fixed upper horizontal wall of the base 34 and the outer edge of the pair of opposite discs 11''' of the upper wheel 11 of the rotating wheel R thereby ensuring the complete closure of the interior of the rotating wheel R.

The tubular shaft 32 supporting the wheels 8 having peripherally open apertures 9 and the rotating wheels R supporting the carriage devices Z extends below the hub 34' into the inside of a housing bounded by walls fixed to the hub 34' and indicated overall by 47. The tubular shaft portion 32 within the housing 47 has keyed on it a conical gear wheel 48 and below this a sleeve-shaped component 49 having at its opposite ends a cylindrical gear toothing 49' and a cylindrical gear toothing 49'' respecively. This conical gear wheel 48 engages with a conical gear wheel 50 keyed on one end of a shaft 51 within the housing 47 and supported horizontally by one of the vertical walls of the housing 47 and in the vicinity of its other end by a support plate 34''' rigid with the base 34. The other end of this horizontal shaft 51 has keyed on it a concial gear wheel 52 which engages with a conical gear wheel 53 keyed in the vicinity of the lower end of a vertical shaft 54 fixed to the output shaft of a motor reducer, indicated overall by 55, fixed to the bottom of the base 34. The said vertical shaft 54 extends upwardly through a horizontal support and guide plate $34^{IV}$ of the base 34 up to the interior of the base 56 of the wrapping apparatus B according to the above mentioned U.S. patent application No. 522,185 in the name of the applicants, for the motor actuation of the wrapping wheels of the said wrapping apparatus B.

The axis of the said wrapping wheels of this wrapping apparatus B is horizontal and lies in a vertical plane passing through the vertical axis of rotation of the three superimposed wheels 4, 8 and R of the supply apparatus A in question. Since, in the embodiment shown, twelve of the handling and twisting devices of the wrapping wheels of the wrapping apparatus B are provided and eighteen of the take-up member means 10 associated with the supply apparatus A in question are provided, the above-mentioned conical gear wheels 52 and 53 are dimensioned for a synchronized transmission ratio of two to three between this apparatus A and B.

The toothing of a gear 57 keyed on the upper end within the housing 47 of a shaft 58 supported by the base wall of the housing 47 with its lower end projecting from the housing 47 engages with the cylindrical gear toothing 49'' of the sleeve-shaped component 49. A gear 59 in engagement with a gear 60 keyed on the lower end of the shaft 30 supporting the upper conical disc wheel 4 is keyed on the end of the shafts 58 external to the housing 47. The dimensions of the gears 49'', 57, 59 and 60 are selected such that the ratio of transmission to the shafts 32 and 30 supporting the wheels 8 and R and 4 is greater for one rotation of the said wheel 8 and R with respect to that of the wheel 4 for the reasons discussed below.

Two gears 61 and 62 which are substantially opposite enagage, however, with the cylindrical gear toothing 49' of the said sleeve-shaped component 49 (see FIG. 5). The gear 61 is keyed on a shaft 63 (see FIG. 5) supported vertically by the base wall of the housing 47 on whose lower end, external to the housing 47, there is keyed a chain wheel 64 (see FIG. 4). The gear 62 is, however, keyed on a shaft 65 which is also supported vertically by the base wall of the housing 47 whose lower end is also external to the housing 47 and has keyed on it a chain wheel 66 (see FIGS. 4 and 5). The two chain wheels 64 and 66 are provided for the motor actuation of a respective cylindrical blade 67, 68 whose respective functions are discussed below.

The blade 67 is disposed above the conical disc wheel 4 so as to deflect the sweets supplied in bulk thereto downstream of the wrapping apparatus B with respect to the direction or rotation of the arrow f of the superimposed wheels 4, 8 and R of the apparatus A in question, and more particularly slightly upstream of the beginning of the section having a spiral course 7' of the alignment duct 7–7' for the sweets themselves (see FIGS. 1, 3 and 5). The blade 67 is mounted on the end of a shaft 69 supported rotatably in an overhanging manner by a support element 70 fixed vertically to the upper horizontal wall of the base 34. A conical gear 71 is keyed on the other end of this shaft 69, which gear is in engagement with a conical gear 72 keyed, in its turn, on the upper end of a vertical shaft 73 extending downwardly through the support element 70 with its lower end, on which there is keyed a chain wheel 74, at the level of the chain wheel 64. The two chain wheels 64 and 74 are connected by a transmission chain 75.

The blade 68, is however, disposed within the channel 7–7' downstream of its section having a spiral course 7', above the annular zone of the disc 8 having peripherally open apertures 9 (see FIGS. 3 and 5). This blade 68 is mounted on the end of a shaft 76 supported rotatably in an overhanging manner by a support element 77 fixed vertically to the horizontal wall of the said base 34.

At the other end of the shaft 76 there is keyed a conical gear 78 in engagement with a conical gear 79 in turn keyed on the upper end of a vertical shaft 80 extending downwardly through the support element 77 with its lower end, on which there is keyed a chain wheel 81, at the level of the chain wheel 66. The chain wheels 66 and 81 are connected together by a transmission chain 82.

The synchronized motor actuation of the known apparatus D for the cutting and supply of the pieces of material for wrapping the sweets is, however, derived from the shaft 51 in a manner known to persons skilled in the art.

The sweets 6 to be wrapped are supplied in bulk from the supply-vibrator unit 5 above the conical plate wheel 4, which sweets, as is known, are gradually brought into longitudinal alignment, under the action of centrifugal force, at the periphery of the wheel 4, in the first instance within the duct 7 and then along the spiral section 7' of this duct 7–7' such that they are then taken up by the peripheral portion of the wheel 8 having peripherally open apertures 9 which spaces them, since this wheel 8, as mentioned above, has a speed of rotation greater than that of the wheel 4. The sweets spaced in this way on the periphery of the wheel 8 are conveyed below the rotating blade 68 which causes them to fall into the apertures 9 supported by the horizontal fillet 42 which is disposed between the sweets and the respective lower take-up member means 10 associated with the carriage devices Z supported by the rotating wheel R.

As explained above, at a certain point the horizontal fillet 42 is terminated thus enabling the sweets to fall into the cup 10'—10''—10''' constituting the take-up member means 10. When the rotation continues and with the gradual radial movement of the carriage devices Z by means of the cams 38 and 41, the sweets 6 taken up by the respective take-up member means 10 are conveyed from the peripheral path of the wheels 8 and R along the rectilinear horizontal path section L (see FIG. 5) below the continuously moving wheel portion B1 of the wrapping apparatus B as a result of the raising by the cam 39 of the rods 18 supporting the take-up member means 10, where, maintained with a constant orientation with respect to the rectilinear horizontal path section L by means of the rotation imparted to the corresponding rod 18 of the associated toothed sector 28' by the cam 40, they are taken with the associated pieces of wrapping material by the gripper take-up member means 2 associated with the said wheel B1 in order to be wrapped in the double twist wrapper shape, for example, disclosed in the above mentioned U.S. patent application Ser. No. 522,185.

An apparatus for the sequential spacing of sweets having the construction described above and set out in the attached claims of the present invention, in combination, in practice, with a wrapping apparatus B having a predetermined number of handling devices C in accordance with the above mentioned U.S. patent applications Ser. Nos. 522,185 and 522,183, provide for the construction of wrapping machines having high production speeds which may wrap up to and beyond 2000 (two thousand) sweets from the first minute, which production speeds are completely unobtainable with, and more than double that of, sweet wrapping machines at present available on the international market.

It is obvious that in the practical embodiment of the above construction of the apparatus in question any modifications and variants suggested by practice and by its case of application may be made thereto in all cases without departing from the scope of the invention claimed below.

I claim:

1. Apparatus for the sequential supply of sweets or like products to a continuously moving wrapping apparatus or machine of the type designed to convey the sweets to be wrapped along a wrapping path or line having a mixed course and comprising at least one rectilinear horizontal section, the said apparatus being of the type having a superimposed wheel construction, which wheels rotate coaxially with a continuous movement about a vertical axis, and include a first upper plate wheel designed to receive products in bulk and to supply them in single file via a duct having a spiral course to the periphery of a second lower disc wheel, characterised in that the said second wheel is provided peripherally with a plurality or peripherally open equally spaced apertures and that below each of these apertures there are provided take-up member means associated with a third lower wheel in a radially slidable manner so that they may be orientated about a respective vertical axis in order to receive individual products and convey them from the peripheral path of the said second and third wheels along a rectilinear horizontal path section parallel to and below the said rectilinear horizontal path section of the wrapping line of the wrapping machine with a constant orientation with respect to the rectilinear horizontal path sections in order to supply them to the continuously moving wrapping apparatus or machine.

2. Apparatus as claimed in claim 1, characterised in that the said third wheel is a rotating wheel substantially constituted by two superimposed wheels having slide and guide radii connected together by a plurality of peripheral columns, the said guide said slide radii of the two superimposed wheels having mounted on them respective carriage devices associated with a respective vertical rod supporting a corresponding take-up member means, cam means being provided for the radial displacement of the carriage devices along the respective guide and slide radii and cam and toothed sector means also being provided for the rotation of the said rods about their respective axes maintaining a constant orientation of the take-up member means along the rectilinear horizontal section.

3. Apparatus as claimed in claim 2, characterised in that cam means, are provided for the vertical displacement of the said rods supporting take-up member means at least along the rectilinear horizontal section.

4. Apparatus as claimed in claim 1, characterised in that the said second and third wheels have a greater speed of rotation than that of the said first wheel.

5. Apparatus as claimed in claim 1, characterised in that the means for actuating the said three superimposed wheels also actuate the wrapping wheels associated therewith at a transmission ratio of two to three, the take-up member means of the first wheels and the handling devices of the second wheels being provided at a ratio of two to three.

6. A wrapping machine constituted by a sweet supply apparatus having three superimposed wheels which rotate with a continuous movement about a common vertical axis as claimed in claim 1 and by a wrapping apparatus moving continuously about a horizontal axis disposed radially above the said superimposed wheels and designed to take the sweets to be wrapped from a wrapping path line having a mixed course and comprising at least one rectilinear horizontal section in its lower portion.

* * * * *